United States Patent [19]

Kuijer et al.

[11] Patent Number: 4,907,998

[45] Date of Patent: Mar. 13, 1990

[54] A RESILIENTLY DEFORMABLE CONTAINER FOR MERCURY, AND LAMP AND METHOD OF ITS MANUFACTURE USING SUCH A CONTAINER

[75] Inventors: William L. Kuijer; Jacobus P. K. M. Van As; Frans J. Traksel, all of Roosendaal, Netherlands

[73] Assignee: U.S. Philips Corporation, New York, N.Y.

[21] Appl. No.: 734,418

[22] Filed: May 15, 1985

[30] Foreign Application Priority Data

May 18, 1984 [NL] Netherlands ..... 8401596

[51] Int. Cl.[4] ..... H01J 9/38

[52] U.S. Cl. ..... 445/9

[58] Field of Search ..... 445/9, 15, 16, 17, 19, 445/26, 29, 31, 38, 53, 57

[56] References Cited

U.S. PATENT DOCUMENTS 3,913,999 10/1975 Clarke ..... 445/9

3,957,328 5/1976 Van der Wolf ..... 445/9

FOREIGN PATENT DOCUMENTS 0080634 5/1982 Japan ..... 445/9

1475458 6/1977 United Kingdom .

*Primary Examiner*—Kurt Rowan

*Attorney, Agent, or Firm*—David R. Treacy

[57] ABSTRACT

Mercury is dosed into a fluorescent or similar lamp from a container shaped mostly as an elongated flat plate, inserted lengthwise into the exhaust tube and held in place by a rib in the tube engaging depressions in the center of the plate. To permit easy insertion, the end of the plate opposite the mercury container has a relatively large through hole, leaving a thin resilient wall on each side of the hole so that insertion force is minimized.

5 Claims, 1 Drawing Sheet

A RESILIENTLY DEFORMABLE CONTAINER FOR MERCURY, AND LAMP AND METHOD OF ITS MANUFACTURE USING SUCH A CONTAINER

BACKGROUND OF THE INVENTION

The invention relates to a method of manufacturing a mercury vapor discharge lamp, having a lamp vessel provided with an exhaust tube, the quantity of mercury required for the operation of the lamp being present in metallic form in a closed metal container, and more particularly to such a lamp whose container is mainly shaped as a plate arranged in the exhaust tube and held in place by a waist portion of the plate engaging and a rib in the exhaust tube. The container is heated after evacuation of the lamp in a manner such that it opens due to the mercury vapor pressure building up therein. The invention further relates to a lamp manufactured by means of this method and to a container filled with metallic mercury and suitable for carrying out the method as well as to a lamp vessel in which such a closed container filled with mercury is present.

A method of the aforementioned kind is known from British Patent Specification No. 1,475,458. In this Patent Specification, a method of manufacturing a mercury vapor discharge lamp (such as, for example, a low-pressure mercury vapor discharge lamp having a tubular lamp vessel) is described, in which first a closed metal container is arranged in the exhaust tube. The container comprises a first portion containing the mercury and a second, larger portion having the form of a lamina. After substantially all the manufacturing steps relating to the evacuation process (such as degasing the wall and the remaining lamp parts, annealing and degasing the electrodes, providing the rare gas etc.) have been accomplished, the lamp vessel is sealed in a gas-tight manner and the container is heated, for example, by means of a high-frequency electric field. Due to this heating, mercury is released from the holder and moves into the lamp vessel.

Due to the use of a container which is plate-shaped for the major part, and a correct arrangement thereof in the exhaust tube, the flow resistance during the evacuation process is increased to the least possible extent. The container is therefore preferably arranged so that it extends in the longitudinal direction of the exhaust tube. The known container comprises, for example, a flat plate with a small cup which is welded thereto and which contains the mercury.

In the known method, the container is arranged in the exhaust tube by pushing the plate-shaped part of the container in the exhaust tube through the rib until it reaches a position in which the reduced-width portion in the container cooperates with the rib in the exhaust tube. In order to prevent that so much force has to be excerted on the container during this step, that the exhaust tube is damaged, which may even lead to rupture, according to the aforementioned Patent Specification, a slot is provided in the longitudinal direction in the plate-shaped part of the container. The resilient properties are then improved and the plate-shaped part of the container can pass the rib more easily. Moreover, a larger tolerance in the dimensions of the narrow passage at the area of the rib in the exhaust tube is permissible.

It has been found that very strigent requirements have to be imposed on the correct length of the slot. If the slot is too short, the resilient properties are insufficient and there is a risk that during the step of providing the container rupture of the exhaust tube will nevertheless occur. If on the contrary the slot extends over too large a part of the container, the plate-shaped parts located on either side of the slot can be readily deformed when the incision is provided. Such a deformation has the disadvantage that during the sorting and selection step (which precedes the step of providing in the exhaust tube) adjacent containers are liable to hook one into the other, as a result of which disturbances occur. This is disadvantageous especially in a mass-production process.

SUMMARY OF THE INVENTION

The invention has for its object to provide a method of manufacturing a mercury vapour discharge lamp of the kind mentioned in the opening paragraph, which has a container which is shaped so that it can be arranged in a simple and reproducible manner, while avoiding the aforementioned disadvantage. According to the invention such a method is for this purpose characterized in that a centrally arranged hole is present in the plate-shaped part of the container between the waist portion and the end.

The method according to the invention has the advantage that the container is so resilient that it can be secured in the exhaust tube in a reproducible manner, while only a small force need be exerted on the container to push it through the rib in the exhaust tube. It has been found that the risk of rupture of the exhaust tube is considerably reduced.

The hole in the plate-shaped part of the container is provided, for example, by stamping. Such a method is particularly suitable for mechanization. The plate-shaped part need not have a slot. Mercury-filled containers of the shape according to the invention can be readily sorted and selected due to the strongly shifted centre of gravity. Especially during the selection step (in which use is preferably made of a vibration filling device), a considerably smaller number of disturbances occur than in the method according to the aforementioned British Patent Specification.

The resilient properties of the container according to the invention are mainly obtained by means of the comparatively narrow flat metal strip around the hole in the plate-shaped part. The resilient properties then also depend upon the plate thickness. This dependence can be reduced in a particular embodiment of the method, in which a cut is made in the plate-shaped part of the container between the hole and the outer edge of the plate-shaped part near the longitudinal axis. It has been found that not only the resilience of such container is then increased, but that surprisingly also the various containers do not hook one into the other at the area of the cut during the selection and sorting step. These containers can be simply secured in the exhaust tube and can be pushed with a remarkably small force through the rib in the exhaust tube.

The method is preferably used in low-pressure mercury vapour descharge lamps, more particularly in those lamps in which metering of comparatively small quantities of mercury is required, as in compact fluorescent low-pressure mercury vapour discharge lamps (see, for example, U.S. Pat. Nos. 4,374,340 and 4,383,200).

Since the step of heating the container is carried out fully separately from the remaining lamp processing steps, which can therefore also be carried out afterwards by an assembler, the invention further relates to lamps provided with a closed container still filled with mercury. The plate-shaped containers according to the invention can also be marketed as a separate product, for example as a ribbon of intercoupled containers. The invention therefore also relates to these containers.

The invention will be described more fully with reference to the drawing.

Figure 1:
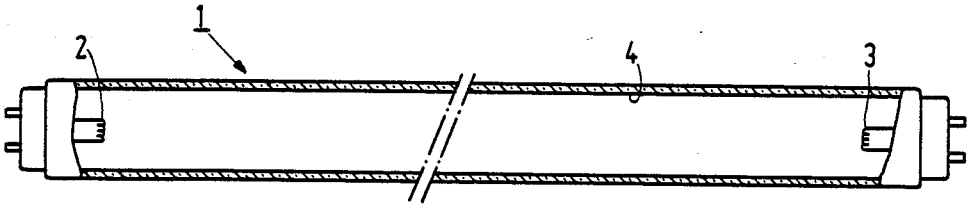
FIG. 1 shows diagrammatic view, partly in elevation and partly in section, of a tubular low-pressure mercury vapour discharge lamp manufactured by means of the method according to the invention.

The lamp shown in FIG. 1 comprises a tubular glass lamp vessel 1 which is provided at its end with electrodes 2 and 3, between which a discharge is maintained during operation of the lamp. A luminescent layer 4 is present on the inner wall of the lamp vessel. The lamp vessel contains a rare gas and a small quantity of mercury provided by means of the method according to the invention.

Figure 2:
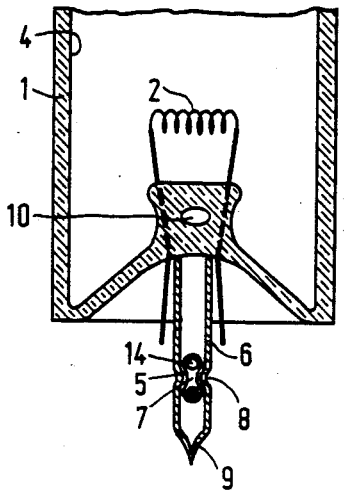
FIG. 2 shows on an enlarged scale a sectional view of an end of the lamp shown in FIG. 1.

The quantity of mercury required for the operation of the lamp is for this purpose present in a metal container 5 which is for the major part plate-shaped and which is arranged in the exhaust tube 6 (see FIG. 2) at the end of the lamp vessel. The container 5 is held in place by a waist portion 7 in the plate-shaped part corresponding to the rib 8 in the exhaust tube. The container 5 is introduced into the exhaust tube by pushing the lower side of this container until it has partly passed the rib (and the rib cooperates with the waist portion). It is otherwise not necessary that the container is arranged in the exhaust tube only after it has been connected with the lamp vessel. The containers are preferably arranged in the correct position in the exhaust tube after the exhaust tube has been connected to a mount. (A mount carries the electrodes, and similar elements.) After the mount has been secured in a gas-tight manner to the end of the lamp vessel, the lamp vessel is evacuated and the exhaust tube is sealed at 9 in a gas-tight manner. Subsequently, the container 5 is inductively heated to such a temperature that it opens due to the mercury vapor pressure building up in it and the mercury vapor reaches the lamp vessel through the opening 10 in the pinch of the mount.

Figure 3:
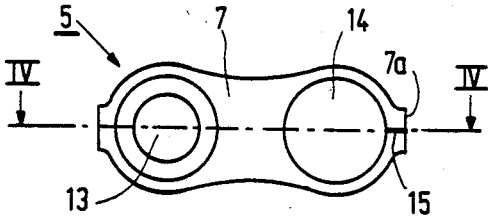
FIG. 3 is an elevation of a container used in the method according to the invention.
Figure 4:
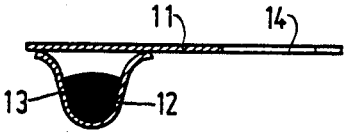
FIG. 4 is a longitudinal sectional view of the container shown in FIG. 3.

As shown in FIGS. 3 and 4, the container has a plate-shaped part 11 with a waist portion 7, as a result of which the container assumes the shape of a figure eight. The mercury 12 is present in a metal cup 13 (see FIG. 4), which is secured by welding to the plate-shaped part 11. A centrally arranged hole 14 is provided by stamping in the plate-shaped part between the reduced-width waist portion 7 and the end 7a. As a result, when the container is introduced into the exhaust tube, resilience is increased. A cut 15 is provided in the remaining comparatively narrow strip of the plate-shaped part at the area of the longitudinal axis for obtaining an optimum resilience.

In a practical embodiment of the method according to the invention of manufacturing a low-pressure mercury vapour discharge lamp of the kind described in U.S. Pat. No. 4,374,340 ("PL"-lamp) having a power of, for example, 11 W, use is made of a metal plate-shaped container having a configuration shown in FIG. 3. The thickness of the plate-shaped part is about 0.1 mm (band steel). The width of the waist portion is about 2.2 mm. At the area of the circular part of the "eight" the diameter is about 3 mm. The length of the capsule is about 7.5 mm. With a rib diameter in the exhaust tube of about 2.8 mm, the force required to push the capsule through the rib is 4 to 6 Newton. The hole has an inner diameter of about 2.4 mm. The metal cup (13, see FIG. 4) contains about 6 mg of mercury.

What is claimed is:

1. An elongated container for dispensing a dose of mercury, comprising a plate-shaped part having a width greater than the thickness thereof, and a mercury-containing portion having a given width in the width direction of said part; said plate-shaped part comprising a waist portion having a width less than said given width, and a resilient portion having a width greater than the width of said waist portion; said waist portion being arranged in the direction of elongation between said resilient portion and said mercury-containing portion, characterized in that said resilient portion has a centrally formed hole extending therethrough in the thickness direction, defining strips on respective opposite sides of the hole, the hole having a width greater than the respective widths of said strips, and said resilient portion extends completely around the periphery of the hole.

2. A container as claimed in claim 1, characterized in that near the longitudinal axis of the elongated container, at an end of the container opposite said mercury-containing portion, said resilient portion is cut.

3. A method of manufacturing a mercury vapor discharge lamp comprising a lamp vessel, and an exhaust tube communicating with said vessel and having an internal rib extending transversely of the tube, comprising the step of inserting a container as claimed in claim 1 or claim 2 into said exhaust tube prior to evacuation of the vessel, said inserting step comprising deforming said resilient portion by pushing it past said rib toward the vessel, and then permitting said resilient portion to expand between the rib and the vessel so that the rib engages said waist portion to retain the container.

4. A mercury vapor discharge lamp comprising a lamp vessel, an exhaust tube communicating therewith and having an internal rib extending transversely of the tube, and an elongated closed metal container for dispensing a dose of mercury, fitted in said exhaust tube and engaging said rib, said container comprising a plate-shaped part having a width greater than the thickness thereof, and a mercury-containing portion having a given width in the width direction of said part; said plate-shaped part comprising a waist portion having a width less than said given width, and a resilient portion having a width greater than the width of said waist portion; said waist portion being arranged between said resilient portion and said mercury-containing portion for engaging the rib, and said resilient portion being disposed between said rib and said vessel, characterized in that said resilient portion has a centrally formed hole extending therethrough in the thickness direction, defining strips on respective opposite sides of the hole, the hole having a width greater than the respective widths of said strips, and said resilient portion extends completely around the periphery of the hole.

5. A lamp as claimed in claim 4, characterized in that near the longitudinal axis of the elongated container, at an end of the container opposite said mercury-containing portion, said resilient portion is cut.

* * * * *